US005275170A

United States Patent [19]

Lewis

[11] Patent Number: 5,275,170

[45] Date of Patent: Jan. 4, 1994

[54] CARDIAC MONITOR MOUNTING BRACKET FOR AMBULANCE COT

[76] Inventor: Richard A. Lewis, #5 Elmwood La., Texarkana, Tex. 75501

[21] Appl. No.: 33,539

[22] Filed: Mar. 18, 1993

[51] Int. Cl.[5] ..... A61B 5/04; A47C 21/00

[52] U.S. Cl. ..... 128/696; 5/503.1; 296/19; 296/20; 128/710

[58] Field of Search ..... 5/503.1; 296/20, 19; 274/158; 128/696, 670, 671, 655, 658, 710

[56] References Cited

U.S. PATENT DOCUMENTS 4,203,175 5/1980 Heine ..... 5/503.1

4,998,277 3/1991 Rioux, Jr. ..... 5/503.1

*Primary Examiner*—Lee S. Cohen

*Assistant Examiner*—Brian M. Green

*Attorney, Agent, or Firm*—Ray F. Cox, Jr.

[57] ABSTRACT

The present invention is a bracket for mounting a portable cardiac monitor to an ambulance cot. It comprises a lightweight framework having support and restraining members to securely hold a cardiac monitor and which mounts to the side rails and frames of an ambulance cot. A strap is provided to secure the carrying handle of the monitor against the possibility of falling or tipping out of the bracket. The bracket is provided with a pair of upper hook members and a pair of lower hook members to hook over the side rails and frame of an ambulance cot.

3 Claims, 1 Drawing Sheet

CARDIAC MONITOR MOUNTING BRACKET FOR AMBULANCE COT

BACKGROUND OF THE INVENTION

1. Technical Field

This invention relates to an apparatus for mounting critical care equipment onto an ambulance cot and, more particularly, to a mounting bracket adapted to the attachment of a portable cardiac monitor to an ambulance cot.

2. Prior Art

A typical ambulance cot has a tubular metal frame construction which comprises a generally rectangular shape with supports for a mattress and with a wheeled undercarriage. The mattress frame is supported on the wheeled undercarriage by an arrangement of collapsible legs so that the cot can be collapsed together for carriage in an ambulance. The cot may be supplied with various additional members, for example side rails. A typical ambulance cot is disclosed in U.S. Pat. No. 3,644,940 issued on Feb. 29, 1972 to Bourgraf, et al. and assigned to Ferno-Washington, Inc. The disclosure of this patent is incorporated herein by reference.

While the typical ambulance cot is provided with various auxiliary fittings for attaching and carrying auxiliary items of equipment, there is a continuing need for additional means to carry securely certain critical care equipment demanded by modern emergency medical usage. Since ambulance cots are most often used in critical care situations, for example in the transport of accident victims or persons in cardiac arrest, and further considering that normally only one or two emergency medical technicians are available to care for the patient, it becomes clear that transporting the ambulance cot, caring for the patient and carrying critical care equipment are very nearly beyond the capabilities of the attending technicians. Accordingly, it has been suggested that an auxiliary apparatus designed for attachment to a typical ambulance cot be provided to carry the additional critical care equipment needed by the patient while being transported on an ambulance cot. An example of such an apparatus is disclosed in U.S. Pat. No. 4,783,109 issued to Bucalo on Nov. 8, 1988 for "Critical Care Equipment Transport System for an Ambulance Stretcher." Bucalo discloses a light tubular framework attachable to a standard ambulance stretcher by known mechanical fittings. The framework of Bucalo supports one or more shelves above a patient on the ambulance cot in order to provide support for critical care equipment that must accompany the patient. The framework additionally provides for bracing and means for mounting critical care equipment on the shelves. While Bucalo directly addresses the need for auxiliary apparatus to mount and carry critical care equipment on standard ambulance cots, the arrangement of Bucalo suffers from certain limitations. In particular, the apparatus may limit access to the patient under certain conditions. A patient in cardiopulmonary arrest may require cardiopulmonary resuscitation or other measures which require unrestricted access to the patient during transport. The framework of Bucalo, while providing access to the patient under most circumstances, is somewhat restrictive due to its placement above and to either side of the patient. Furthermore, the apparatus of Bucalo may tend to promote instability of the ambulance cot. In its fully extended position, the shelves of the Bucalo apparatus are located above the mattress frame of the cot. In this elevated position the location of heavy equipment thereon may render the entire cot top-heavy or otherwise unstable, potentially endangering the patient.

Bucalo is intended to have the general applicability to a wide variety of critical care equipment. Some of the limitations of Bucalo can be overcome by providing for an apparatus strictly adapted to the transport of single type of commonly used critical care equipment. In the case of the present invention, carrying means are adapted to a portable cardiac monitor. The apparatus is intended to mount by a hook arrangement to the frame and side rails of a typical ambulance cot. The prior art discloses various arrangements for mounting equipment to the side rails of typical hospital beds which are constructed similarly to an ambulance cot in that both utilize tubular metal frameworks.

U.S Pat. No. 4,504,992 issued to Herron, et al. on Mar. 19, 1985 for "Hospital Bed Telephone Holder" discloses a device utilizing a single hook portion for engagement over the upper horizontal rail of a hospital bed in order to support a telephone. A variant arrangement for attaching a telephone to a hospital bed is disclosed in U.S. Pat. No. 4,998,277 issued to Rioux on Mar. 5, 1991 for "Telephone Hanger for Hospital Bed." Rioux discloses a bracket having opposed upper and lower hooks to secure the holder to the upper and lower rails of the hospital bed rail assembly.

U.S. Pat. No. 3,586,276 issued to O'Mahoney on Jun. 22, 1971 for "Supporting Structure and Basket" discloses an apparatus for attaching a basket to hospital bed rails comprising an upper hook mechanism and a pair of lower clips.

None of the cited patents, however, address the particular problem of securely mounting a portable cardiac monitor to the framework of an ambulance cot.

SUMMARY OF THE INVENTION

The apparatus of the present invention is particularly adapted to mounting a portable cardiac monitor to a typical ambulance cot. The typical portable cardiac monitor, such as the Lifepak 5/10, is a rectangular shaped case having a built-in carrying handle. The present invention provides a simple and lightweight bracket which securely receives and holds the cardiac monitor and which securely mounts to the side rails and frames of the ambulance cot.

The present invention comprises a lightweight framework having support and restraining members to securely hold the cardiac monitor. In addition, a strap is provided to fasten about the carrying handle of the monitor in order to secure the monitor into the bracket against the possibility of falling or tipping out of the bracket. The bracket itself is provided a pair of upper hook members and a pair of lower hook members to hook over the side rails or frame of the ambulance cot. By providing both upper and lower hook members, the mounting of the cardiac monitor to the ambulance cot is rendered more secure and less liable to excessive movement. The mounting bracket can, however, be used in situations where only a single mounting rail is available by employing the upper hook members only.

An object of the present invention, therefore, is to provide a simple, quick and lightweight means for attaching a portable cardiac monitor to an ambulance cot.

It is also an object of the present invention to provide a mounting bracket to mount a cardiac monitor to an ambulance cot such that emergency medical technicians are freed from the need to carry the cardiac monitor while also involved in moving or caring for the patient.

It is a further object of the present invention to provide for an apparatus to mount a portable cardiac monitor to an ambulance cot that provides for complete access to a patient in cardiopulmonary arrest.

It is additionally an object of the present invention to provide for a cardiac monitor mounting bracket that is strong and lightweight and can be adapted to mounting to all standard one and two-man ambulance cots and stretchers.

It is yet another object of the present invention to provide for a cardiac monitor mounting bracket for an ambulance cot that will not interfere with an function of the cardiac monitor or the ambulance cot.

Further objects and advantages of the present invention will become apparent from the following detailed description of the preferred embodiment in conjunction with the appended drawings.

DETAILED DESCRIPTION OF THE PREFERRED EMBODIMENT

Figure 1:
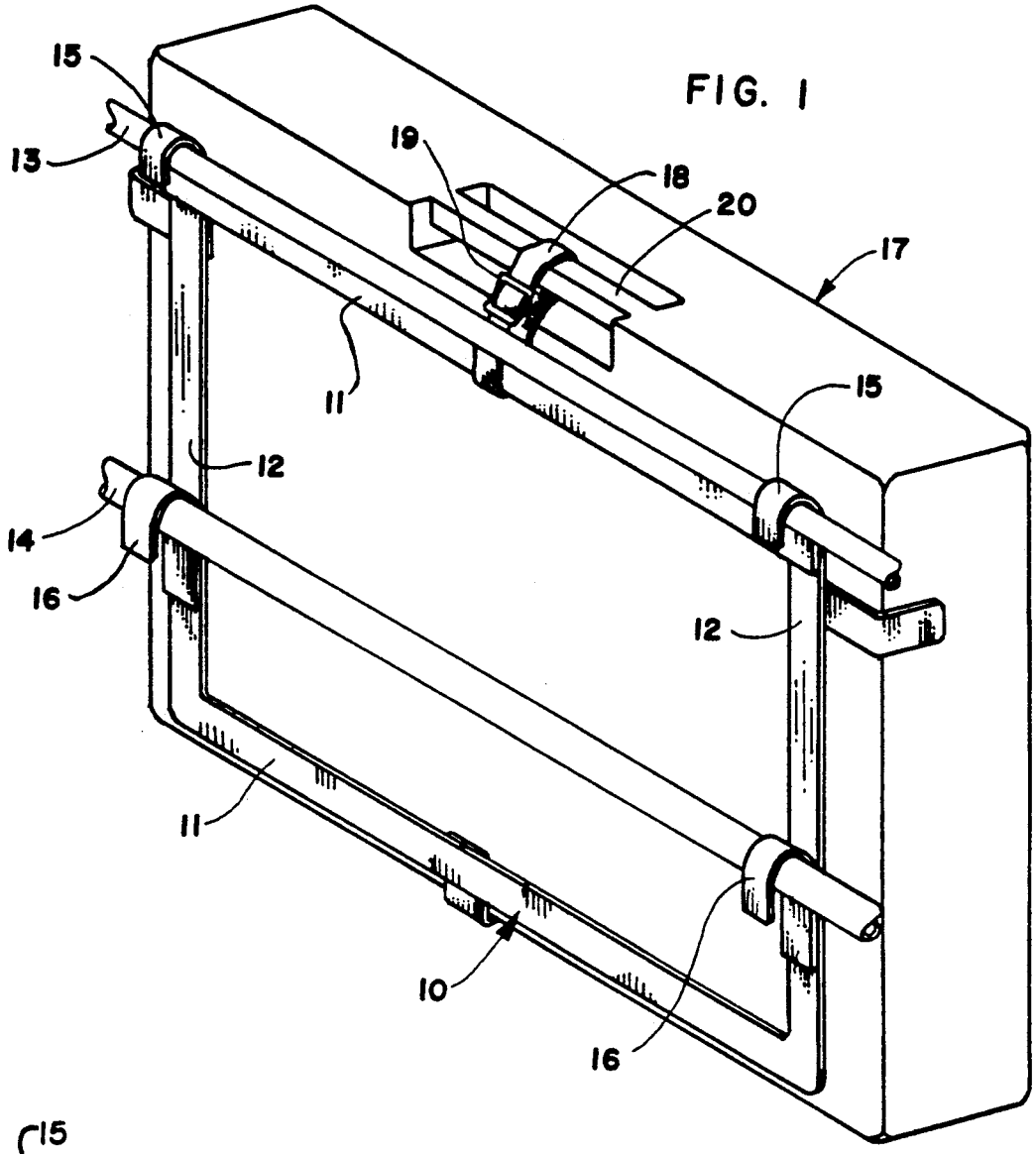
FIG. 1 is a perspective view of the present invention holding a portable cardiac monitor in place on a standard ambulance cot. Only the rails of the ambulance cot are shown.

With reference to FIG. 1, the present invention comprises a rear frame 10 to which the other elements of the invention are attached. In the preferred embodiment, the rear frame 10 is simply a rectangular shape comprised of a pair of horizontal members 11 and a pair of vertical members 12. This particular arrangement for the rear frame 10 has the advantage of light weight with adequate rigidity and supporting power. Without departing from the scope of the present invention, however, the rear frame could be a single, solid rectangular sheet or any other arrangement that provides adequate rigidity, supporting power and points of attachment for the remaining elements of the invention.

Again with reference to FIG. 1, the means for attachment of the bracket to the ambulance cot are shown with reference to a typical side rail 13 and cot frame member 14 of a typical ambulance cot. For the sake of clarity, the remainder of the ambulance cot is not shown. A pair of upper hook members 15 are rigidly affixed to the rear frame 10 at a top edge of the rear frame 10. The upper hook members 15 are sized and arranged to engage the side rail 13. A pair of lower hook members 16 are rigidly affixed to a bottom edge of the rear frame 10 for engaging the cot frame member 14. While use of both the upper hook members 15 and the lower hook members 16 are desirable for providing extra stability to the carrying arrangement, the present invention can be used with the upper hook members 15 alone in circumstances where only a single rail is available for convenient attachment.

With reference to FIG. 1, a typical portable cardiac monitor 17 is shown in place on the present invention. The means for securely supporting the cardiac monitor 17 ar described below. In order to secure the cardiac monitor 17 against accidental upset, a restraining belt 18 is attached to a central portion of the upper edge of the rear frame 10. The restraining belt is provided with a quick-connect latch 19. The restraining belt 18 is passed around the carrying handle 20 of the cardiac monitor 17 and secured With the quick-connect latch 19.

Figure 2:
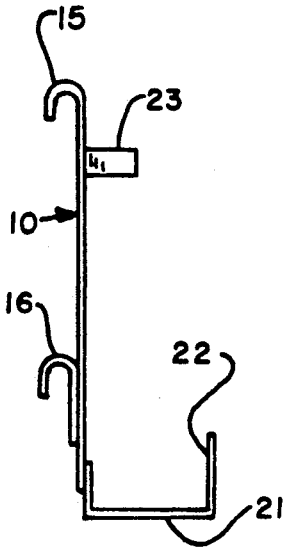
FIG. 2 is side elevation of the present invention.
Figure 3:
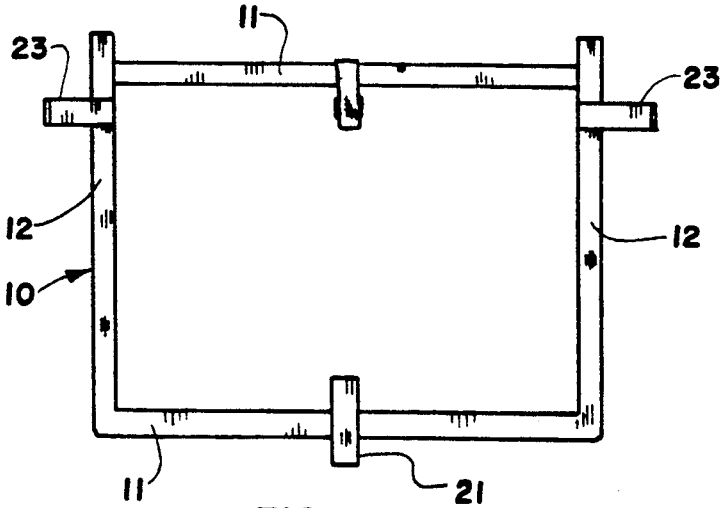
FIG. 3 is a front elevation of the present invention.

The support and restraining elements of the invention are described with reference to FIGS. 2 and 3. A support member 21 extends outward from the bottom edge of the rear frame 10. The support member 21 has a front flange 22 extending upwardly from the support member 21 so as to define a space for receiving and supporting the cardiac monitor 17. In addition, a pair of restraining members 23 extend outwardly from the upper side of the rear frame 10 so that the cardiac monitor 17 is restrained from sideways movement.

The present invention has been described with reference to a preferred embodiment which should be considered as exemplary and not by way of limitation to the full scope of the invention as set forth in the following claims.

What is claimed is:

1. A cardiac monitor mounting bracket for mounting a cardiac monitor onto an ambulance cot of the type having a tubular metal frame and one or more side rails, comprising:

(a) a rear frame;

(b) a pair of upper hook members extending rearwardly from a top edge of said rear frame for engaging a side rail;

(c) a support member extending forwardly from a bottom edge of said rear frame and having a front flange defining a space for receiving and supporting a cardiac monitor;

(d) a pair of restraining members, each at an upper side edge of said rear frame, extending forwardly therefrom such that the cardiac monitor is restrained from sideways movement; and (e) means for securing the cardiac monitor to said mounting bracket.

2. The mounting bracket of claim 1, further comprising a pair of lower hook members extending rearwardly from said bottom edge of said rear frame for engaging the tubular metal frame.

3. The mounting bracket of claim 2 wherein said means for securing comprises a restraining belt attached to a central portion of said top edge of said rear frame and having a quick-connect latch for receiving the cardiac monitor to said mounting bracket.

* * * * *